US006537138B2

(12) United States Patent
Ohmori et al.

(10) Patent No.: US 6,537,138 B2
(45) Date of Patent: Mar. 25, 2003

(54) METHOD OF GRINDING AN AXIALLY ASYMMETRIC ASPHERICAL MIRROR

(75) Inventors: Hitoshi Ohmori, Wako (JP); Yutaka Yamagata, Wako (JP); Sei Moriyasu, Tokyo (JP); Shinya Morita, Tokyo (JP); Katsuhiko Kada, Kyotu-fu (JP); Hidetaka Kira, Joyo (JP); Hiroyuki Sasai, Kyoto (JP); Masaru Kawata, Takatsuki (JP)

(73) Assignees: Riken (JP); Shimadzu Corporation (JP)

( * ) Notice: Subject to any disclaimer, the term of this patent is extended or adjusted under 35 U.S.C. 154(b) by 123 days.

(21) Appl. No.: 09/793,421

(22) Filed: Feb. 27, 2001

(65) Prior Publication Data

US 2001/0024934 A1 Sep. 27, 2001

(30) Foreign Application Priority Data

Mar. 3, 2000 (JP) ..... 2000-058282

(51) Int. Cl.[7] ..... B24B 53/00
(52) U.S. Cl. ..... 451/56; 451/72; 451/41
(58) Field of Search ..... 451/56, 42, 41, 451/72; 125/11.01

(56) References Cited

U.S. PATENT DOCUMENTS 4,849,599 A * 7/1989 Kuromatsu ..... 219/69.17
5,547,414 A * 8/1996 Ohmori ..... 451/21

FOREIGN PATENT DOCUMENTS

| | | | | |
|---|---|---|---|---|
| JP | 40-4082662 | * | 3/1992 | ..... 451/72 |
| JP | 40-4159039 | * | 6/1992 | ..... 451/56 |
| JP | 40-4164570 | * | 6/1992 | ..... 125/11.01 |
| JP | 40-4210364 | * | 7/1992 | ..... 451/42 |
| JP | 10-328995 A | | 12/1998 | |

* cited by examiner

*Primary Examiner*—Robert A. Rose
(74) *Attorney, Agent, or Firm*—Griffin & Szipl, P.C.

(57) ABSTRACT

An electrolytic in-process dressing device 10 is provided with a disk-shaped metal-bonded grindstone 2 with a surface 2*a* with a circular arc shape with a radius R at its outer periphery and a numerical control device 16. The disk-shaped metal-bonded grindstone 2 rotates around an axis Y, and the grindstone is dressed electrolytically while the device 10 grinds the workpiece 1. The numerical control device 16 is provided with a rotary truing device 12 that rotates around the X axis that orthogonally crosses the axis of rotation Y and trues the circular arc surface 2*a*, a shape measuring device 14 for measuring the shape of the circular arc surface of the grindstone and the shape of the processed surface of workpiece 1 on the machine, and controls the grindstone numerically in the three directions along the axes X, Y and Z. The numerical control device 16 moves the grindstone in three axial directions and repeats the operations of truing, grinding and measurements on-line. Thus, an axially asymmetrical aspheric mirror with a highly accurate shape and extremely low surface roughness, that can precisely reflect or converge light can be manufactured within a short time with a high accuracy.

5 Claims, 6 Drawing Sheets

FOCUSING OF A MIRROR SHAPED AS A ROTATED ELLIPSE

METHOD OF GRINDING AN AXIALLY ASYMMETRIC ASPHERICAL MIRROR

BACKGROUND OF THE INVENTION

1. Technical Field of the Invention

The present invention relates to a method of grinding an axially asymmetric aspherical mirror.

2. Prior Art

A reflecting mirror with an axially asymmetric aspherical surface such as an elliptical surface, parabolic surface or hyperbolic surface (called an axially asymmetric aspherical mirror) is used as an optical element that reflects, focuses or disperses X-rays, laser light, visible light, etc. For instance the mirror with a surface formed by rotating an ellipse shown in FIG. 1A has two focal points F1, F2, and has the intrinsic characteristic that light passing from one focal point F1 is reflected by the elliptical surface of the mirror and travels to the other focal point F2. This elliptical surface mirror also has the characteristic that the mirror converges the light from the focal point F1 into the focal point F2 with high precision. More precisely, as shown in FIG. 1B, a light source with a diameter of 1 mm, for example, located at the focal point F1 is focused by the mirror with a surface formed by rotating an ellipse, into one 200th to 1,000th of the diameter, that is, the light is intensely converged into a spot several microns in diameter. Therefore, these characteristics can be utilized in various applications; for example, the intensity of weak X-rays from an X-ray tube can be increased and used in chemical analysis, soil analysis, etc. using absorption photometry, or a beam of laser light can be converged precisely and used in a laser application such as a laser scalpel.

The necessary conditions for the aforementioned axially asymmetric aspherical surface mirror to achieve the above objectives include the requirements that the shape of the reflecting surface of the axially asymmetric aspherical mirror must be produced with an accuracy of ¼ or less of the wavelength λ of the light to be used (for example, 0.3 μm or less), and that the mirror finish must have a roughness of its reflecting surface of 4 Å (0.4 nm) or less.

However, the conventional means of producing such an ultra-precision mirror surface require a very long time (for instance, several months or more), consequently, this restricts the practical application of axially asymmetric aspherical mirrors, and this is a practical problem.

More explicitly, according to conventional means of processing, the mirror is processed by lapping or by conventional grinding to a surface roughness Rmax of 1~2 μm (1,000~2,000 nm), i.e. the practical limit of processing, then the surface of the mirror is finished to the necessary surface roughness (for example, several Å) by polishing. However, the polishing allowance normally required is about 10 times the surface roughness before processing, so, in practice, a depth of 10~20 μm must be removed by polishing, that is, the processing amount is very large. As a result, for a conventional polishing system in which an elastic deformable tool is lightly pressed onto the surface of an optical element, carefully avoiding damage to the surface, and a slurry containing microscopic grinding grains is used, the polishing time to process a depth of 10~20 μm can be as long as several months or more.

When an amount of 10~20 μm is removed by polishing, the residual stress on the surface caused by lapping or grinding is removed, therefore the accuracy of the processed surface with respect to a reference surface becomes worse, and this is another problem. In order to achieve the necessary accuracy in the shape of an ultra-precision mirror surface (λ/4 or less), the reference surface must be reprocessed after being polished once, and then the polishing and reprocessing should be repeated until the necessary accuracy is obtained. Still another problem is that while repeating these operations, the reference surface of an optical element is often changed.

FIGS. 2A, 2B and 2C shows another example of an axially asymmetrical aspherical mirror, that is a mirror with a rotated elliptical surface in this example. A curved surface with a large radius of curvature is processed on the surface of a rectangular block of raw material (quartz etc.) Therefore if a processing tool, for instance, a pole-nose grindstone is used that rotates around an axis normal to the surface of the raw material (upper surface in FIG. 2C), the processing efficiency at the center of the lower surface is low resulting in an inferior surface roughness. Conversely, if a processing tool, for instance, a cylindrical grindstone is used which rotates about an axis parallel to the surface of the raw material (upper surface in FIG. 2C), the axis of rotation must be long to avoid interference with the raw material, and the accuracy of the process is poor due to the effect of shaft deformation.

SUMMARY OF THE INVENTION

The present invention is aimed to solve the above-mentioned problems. In other words, an object of the present invention is to provide a method of grinding an axially asymmetric aspherical mirror with a highly accurate shape, superior surface smoothness and the capability of precisely reflecting or converging light.

According to the present invention, the apparatus is provided with a disk-shaped metal-bonded grindstone (2) with a surface **(2*a*) shaped as circular arc with a radius R on the outer rim thereof, that rotates about an axis Y, an electrode (4) placed opposite the aforementioned grindstone with a space between them, a nozzle (6) that supplies a conducting liquid between the grindstone and the electrode, a device (8) for applying a voltage between the grindstone and the electrode, an electrolytic in-process dressing device (10) that electrolytically dresses the grindstone while a workpiece (1) is being ground, a rotating truing device (12) that rotates around an axis X that is orthogonal to the above-mentioned axis of rotation Y and trues the aforementioned circular arc surface, a shape measuring device (14) for measuring the shape of the circular arc surface of the above-mentioned grindstone and the processed shape of the workpiece (1), and a numerical control device (16) that numerically controls the aforementioned grindstone in three directions along the axes X, Y and Z. The grindstone is moved in the directions of each of the three axes by means of the numerical control device (16)**, while the operations of truing, grinding and measuring are repeated on the machine.

According to the above-mentioned method of the present invention, the grindstone can be moved in the direction of the three axes by the numerical control device (16), and by means of the rotary truing device (12), the circular arc surface (2*a*) can be precisely trued on the outer periphery of the grindstone. In addition, by using the electrolytic in-process dressing device (10) that removes metallurgically bonded grinding grains from the surface of the grindstone by electrolytic dressing, as the workpiece is being ground, high-precision processing can be implemented with a high efficiency even with finer grinding grains than are used in conventional grinding methods, without the grindstone becoming clogged. Furthermore, because the shape measuring device (14) measures the shape of the circular arc on the surface of the grindstone after truing and the processed shape of the workpiece (1) after grinding, on the machine, and the data used for processing are compensated according to the measured data and the workpiece can be reprocessed, the preferred shape can be accurately processed while correcting for wear of the grindstone and processing errors.

Another aspect of the method of the present invention is that because the electrolytic in-process dressing device (10), the rotary truing device (12) and the shape measuring device (14) are provided on the same equipment, and the workpiece is mounted on a common installation device, the workpiece can be processed and measured repeatedly without removing it from the installation device, so the reference surface of an optical element need not be reprocessed, and the reference surface is absolutely free from any displacements that might be caused by remounting in a conventional method known in the prior art.

In a preferred embodiment of the present invention, the processing surface of the workpiece (1) is tilted at an angle of between 30° and 60° relative to the axis of rotation Y of the metal-bonded grindstone (2).

If the diameter of the circular disk-shaped grindstone is made sufficiently smaller than the minimum radius of curvature of the axially asymmetric aspherical surface to be achieved during processing an axially asymmetric aspherical surface according to the method mentioned above, the shaft of the metal-bonded grindstone (2) need not be extended to avoid interference between the workpiece (1) and the axis of rotation of the grindstone, therefore, deflections thereof can be minimized, and a high processing accuracy can be maintained.

Moreover, the surface of the workpiece (1) to be processed is ground by feeding the above-mentioned grindstone in the direction of the axis of rotation Y thereof at a relatively high speed and moving the grindstone in the X direction orthogonal to the axis Y at a relatively low speed.

As a result of the above-mentioned method, it is possible to prevent microscopic elevations and recesses on the surface of the grindstone from being reproduced on the processed surface of the workpiece (1), therefore, the processed surface obtained is excellent in terms of surface roughness.

In addition, a laser-type shape measuring device or a contact-type shape measuring device should preferably be used as the aforementioned shape measuring device.

By using a laser-type shape measuring device, the shape of the circular arc surface of the grindstone and the processed surface of the workpiece can be measured on the machine with a high accuracy from a location some distance away from the machine. On the other hand by using the contact-type shape measuring device, on-machine measurements can be made reliably even under adverse conditions.

Other objects and advantages of the present invention are revealed in the following paragraphs referring to the attached drawings.

DESCRIPTION OF PREFERRED EMBODIMENTS

Figure 1A:
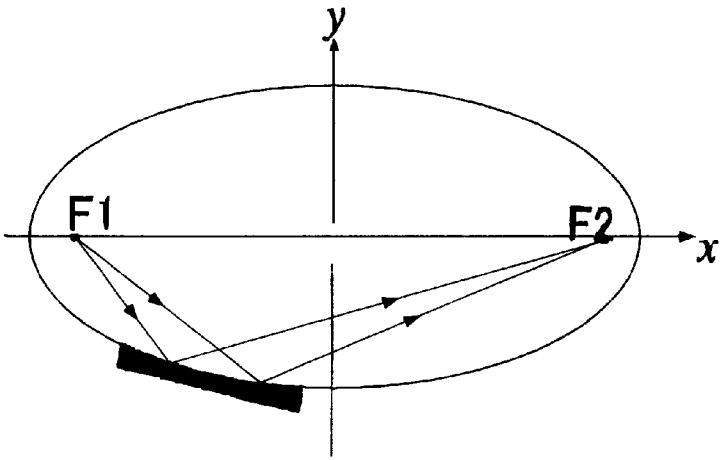
FIGS. 1A and 1B are sketches of light focussed by a mirror with a surface formed by rotating an ellipse.
Figure 1B:
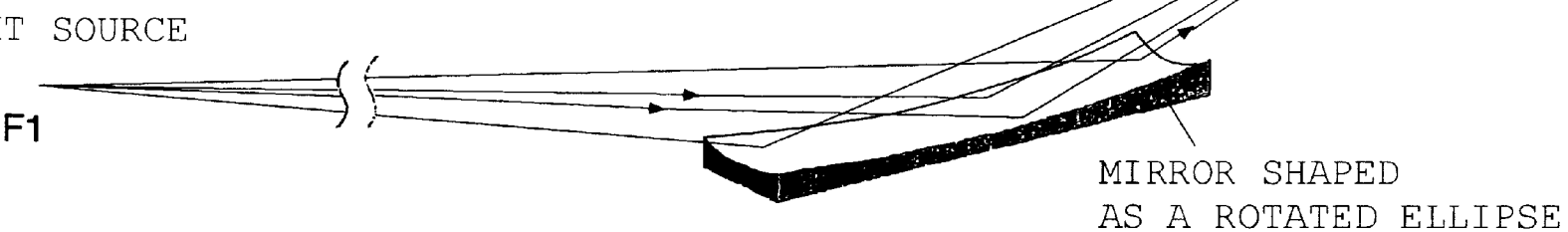
Figure 2A:
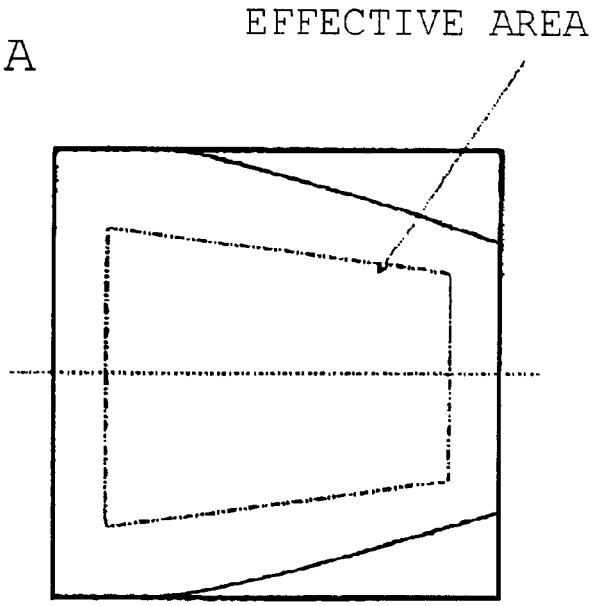
FIGS. 2A, 2B and 2C show the shape of a mirror with a surface formed by rotating an ellipse.
Figure 2B:
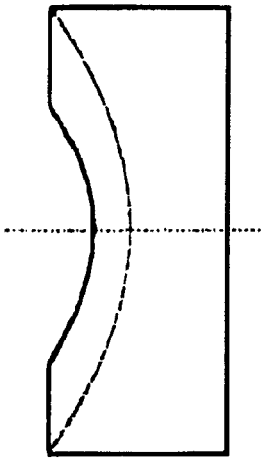
Figure 2C:
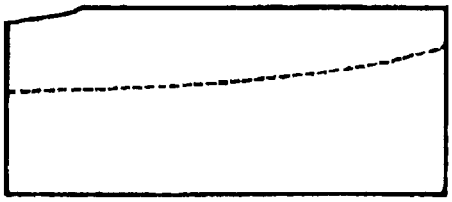

Preferred embodiments of the present invention are described referring to the drawings. In each drawing, common portions are identified with the same reference numbers, and duplicate descriptions are omitted.

Figure 3:
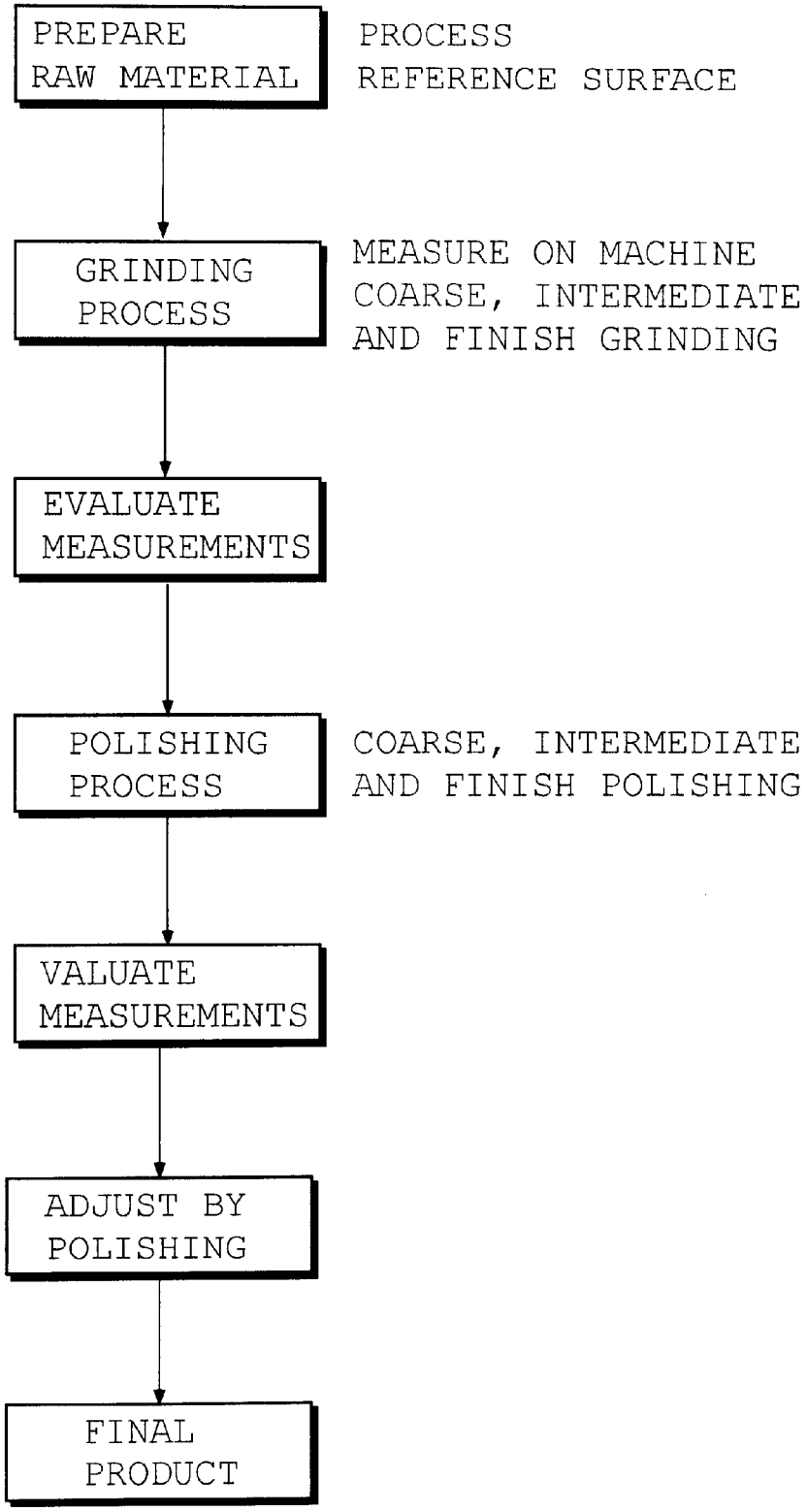
FIG. 3 is a flow chart for producing an axially asymmetric aspherical mirror according to the present invention.

FIG. 3 is a flow chart for processing an axially asymmetric aspherical mirror. As shown in FIG. 3, the raw material must be prepared, and grinding and polishing processes are required to produce the axially asymmetric aspherical mirror. Although the following embodiments are described using a mirror with a rotated elliptical surface as example of an axially asymmetric aspherical mirror, the present invention should not be limited only to this mirror, but the invention can also be applied to reflecting mirrors with axially asymmetric aspherical surfaces known in the prior art, including rotated parabolic surfaces and rotated hyperbolic surfaces.

Referring to FIG. 3, the raw material of an axially asymmetric aspherical mirror is prepared by selecting from the following materials—ceramics such as CVD-SiC, optical glasses such as quartz glass, single-crystal silicon, etc. A necessary reference surface is machined on the selected material.

In the grinding process according to the present invention, a workpiece is subject to coarse grinding, intermediate grinding and finishing grinding while measurements are carried out on-machine (measurements with the workpiece mounted on the apparatus). For measurements and evaluations carried out after grinding, the ground shape is measured repeatedly using a 3-dimensional digitizer etc. together with on-machine measurements, and the necessary evaluations are performed.

In the polishing process, the workpiece is subjected to coarse, intermediate and finishing polishing so as to achieve a reflecting surface with an excellent mirror finish in terms of surface roughness. After polishing, measurements and evaluations are carried out by repeating the measurements of shapes and surface roughnesses after polishing. Next, if required, the workpiece is polished to make corrections, thus the final product (an axially asymmetric aspherical mirror) is completed.

The method of the present invention relates to the aforementioned preparations of the raw material and the grinding process.

Figure 4:
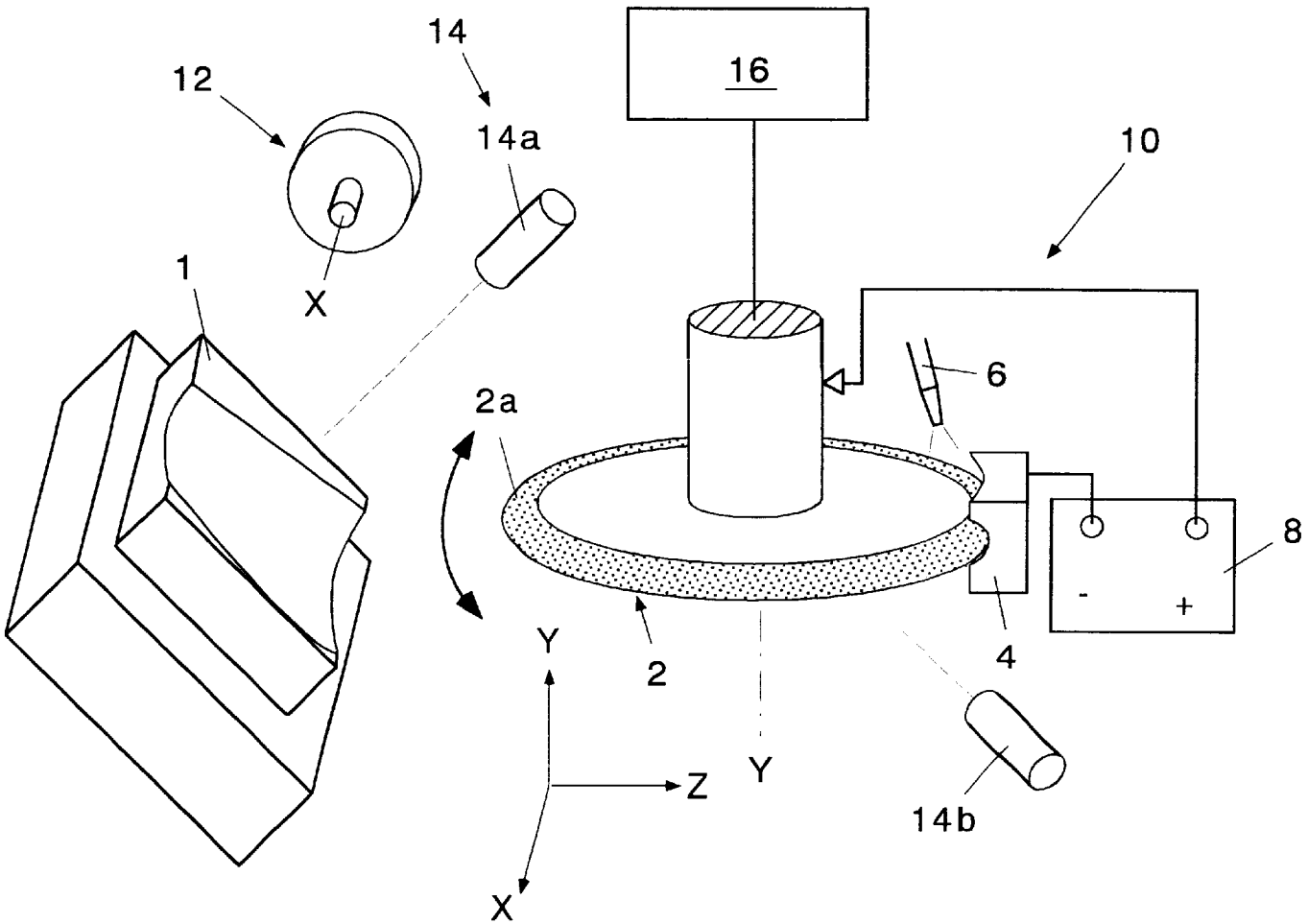
FIG. 4 shows a configuration of a grinding apparatus based on the method of the present invention.

FIG. 4 shows the configuration of a grinding apparatus used in the method of the present invention. This grinding apparatus is provided with, as shown in FIG. 4, an electrolytic in-process dressing device 10, a rotary truing device 12, a shape measuring device 14 and a numerical control device 16.

The electrolytic in-process dressing device 10 (called an ELID grinding device) is composed of a disk-shaped metal-bonded grindstone 2 that is rotated by a drive mechanism, not illustrated, about an axis Y (in this example, the vertical axis), an electrode 4 placed opposite the grindstone with a small spacing between them, a nozzle 6 that feeds a conducting liquid between the grindstone 2 and the electrode 4, and a power supply device 8 that applies a voltage between the grindstone 2 and the electrode 4. In addition, the metal-bonded grindstone 2 is provided with a surface 2*a* shaped as a circular arc with a radius R at the outer periphery thereof.

According to this configuration, the workpiece 1 can be ground while the grindstone 2 is being electrolytically dressed. This ELID grinding device 10 can, even when fine grinding grains are used, process the workpiece with a high efficiency and a high accuracy without the grindstone becoming clogged, unlike a conventional grinding system.

The rotary truing device 12 is rotated by a drive mechanism, not illustrated, about the X axis (in FIG. 4, the horizontal axis) that crosses the axis Y of rotation of the grindstone 2 orthogonally. The rotary truing device 12 is, for instance, a cylindrical diamond grindstone, and can keep the surface 2*a* of the grindstone 2 a true circular arc by contacting the outer periphery thereof with the grindstone 2.

The shape measuring device 14 is, in this example, a laser-type shape measuring device, but it can be a contact-type shape measuring device. Using the laser-type shape measuring device, the shape of the circular arc surface of the grindstone and the processed shape of the workpiece can be measured on the machine with a high accuracy. Also using the contact-type shape measuring device, on-machine measurements can be securely carried out even under adverse conditions.

In FIG. 4, the shape measuring device 14 is composed of two laser-type shape measuring devices 14*a*, 14*b* for measuring the processed surface and the grindstone surface. The shape measuring device 14*a* for measuring the processed surface is installed on the drive head, not illustrated, of the grindstone as it must be able to be moved together with the grindstone 2. The shape measuring device 14*b* for measuring the grindstone surface is fixed to the workpiece 1, in the same way as device 14*a*. Using this configuration, the shape of the circular arc of the surface of grindstone 2 and the processed shape of the workpiece 1 can be measured on the machine by moving the shape measuring device 14*a* for measuring the processed surface, together with the grindstone.

The numerical control device 16 controls the position of the grindstone 2 numerically in the three axial directions X, Y and Z, to true the surface with the truing device 12 when it contacts grindstone 2, for grinding the workpiece 1 when the grindstone 2 contacts the workpiece, and for on-machine measurements using the shape measuring device 14.

According to still another aspect of the method of the present invention, as shown in FIG. 4, the surface of the workpiece 1 being processed is tilted relative to the axis of rotation Y of the metal-bonded grindstone 2 by an angle between 30° and 60° (for instance, 45°) and is fixed to the machine, therefore, even if the diameter of the disk-shaped grindstone is made considerably smaller than the minimum radius of curvature of the axially asymmetric aspherical surface so as to be able to process the surface to achieve the target shape, the shaft of the metal-bonded grindstone 2 need not be so long to avoid interference between the workpiece 1 and the shaft of the grindstone, consequently, the deflection thereof can be kept to a minimum, while maintaining a high processing accuracy.

Further according to another aspect of the method of the present invention, as shown by the bi-directional arrow in FIG. 4, the grindstone 2 moves quickly in the direction of the axis of rotation Y thereof, relative to the surface of the workpiece 1 being processed, while the grindstone is moved slowly in the X direction, orthogonal to the axis Y, and grinds the workpiece, so that microscopic imperfections on the surface of the grindstone are not transferred to the surface of the workpiece 1 being processed, thus the surface being processed is finished with an excellent surface smoothness.

Figure 5A:
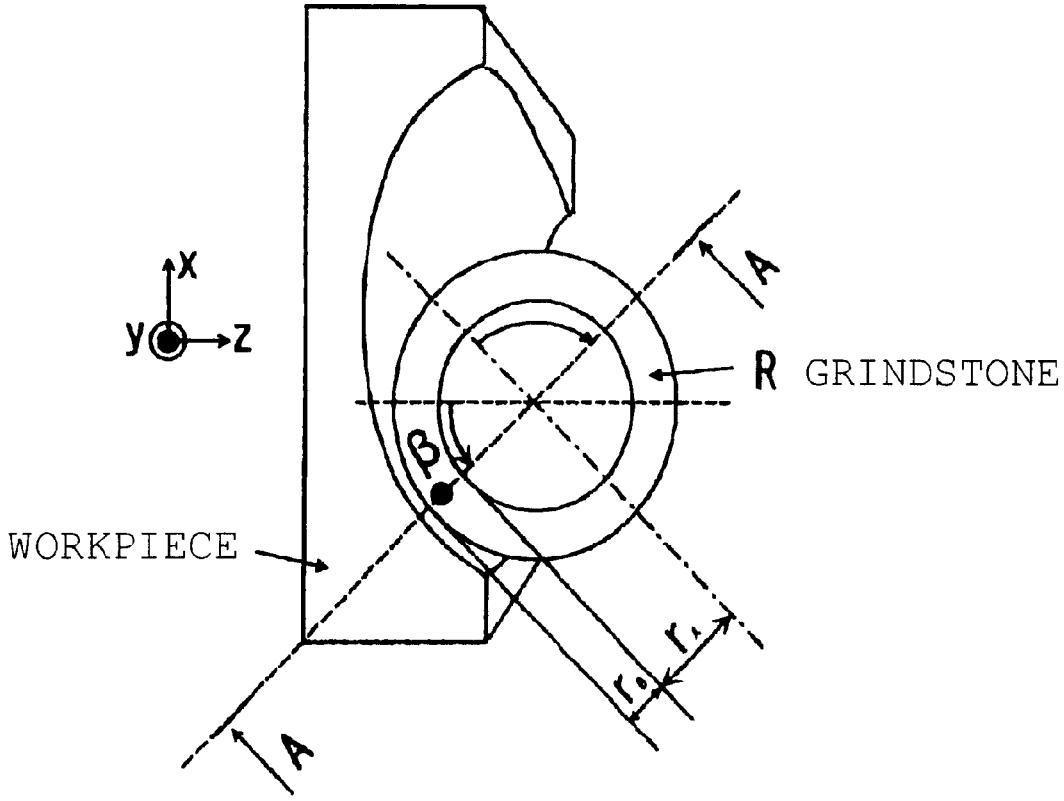
FIGS. 5A and 5B show the relative positions of a grindstone and a workpiece in the grinding method according to the present invention.
Figure 5B:
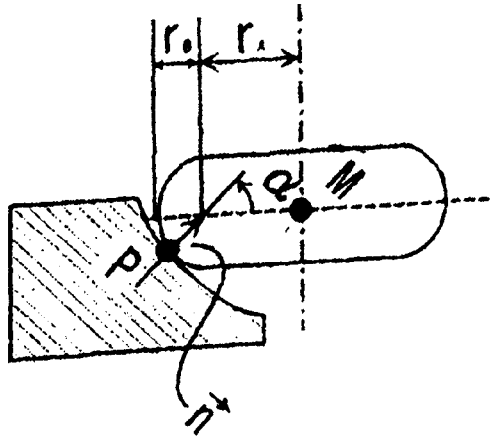

FIGS. 5A and 5B show the relative positions of the grindstone and the workpiece in the grinding method according to the present invention. FIG. 5A is a view seen along the axis of rotation Y of the grindstone 2, and FIG. 5B is a sectional view along the line A—A.

If the angle between the rotating surface of the grindstone and the line normal to the surface being processed is $\alpha$ and the angle between the Z axis and the line normal to the surface being processed is $\beta$, the vector of the normal line corresponding to the shape of the surface being processed is shown by equation (1), and the vector of the relative position of the tool is represented by equation (2).

In addition, the equations (4) and (5) are derived by considering the design shape of the surface being processed (for instance, a rotated elliptical surface) given by equation (3).

[Mathematical presentation 1]

$$\vec{n} = \begin{pmatrix} \cos\alpha \cdot \sin\beta \\ \sin\alpha \\ \cos\alpha \cdot \cos\beta \end{pmatrix} \tag{1}$$

$$\overrightarrow{PM} = r \cdot \vec{n} + Ro \cdot \begin{pmatrix} -\sin\beta \\ 0 \\ \cos\beta \end{pmatrix} \tag{2}$$

$$z = f(x, y) \tag{3}$$

-continued $$\therefore \vec{n} = \frac{1}{L}\left(-\frac{\partial f}{\partial x}, -\frac{\partial f}{\partial y}, 1\right) \text{ where } L = \sqrt{1 + \left(\frac{\partial f}{\partial x}\right)^2 + \left(\frac{\partial f}{\partial y}\right)^2} \tag{4}$$

$$\alpha = \tan^{-1}\left(\frac{-\frac{\partial f}{\partial y}}{\sqrt{1 + \left(\frac{\partial f}{\partial x}\right)^2}}\right), \quad \beta = \tan^{-1}\left(-\frac{\partial f}{\partial x}\right) \tag{5}$$

Therefore, by calculating a NC path for the numerical control process from equations (1) to (5), the surface being processed can be precisely ground even if the radius R of the circular arc surface 2*a* of the metal-bonded grindstone 2 varies.

[Embodiments]

Using the aforementioned grinding device, the method of the present invention was carried out. Table 1 shows the processing conditions thereof.

TABLE 1

| | |
|---|---|
| Workpiece | Quartz glass with the surface of a rotated ellipse |
| Processing device | Ultra-precision 4-axes CNC machining tool ULG-100C (H3) (Toshiba Machine Co., Ltd.) |
| Grindstone | Cast iron bonded diamond grindstone (Fuji Dies Co., Ltd.) |
| ELID conditions | ELID power supply device ED-1503T (Fuji Dies Co., Ltd.) Voltage Vp = 60 V, maximum current Ip = 15 A Pulse intervals τon = 20 μs Pulse waveform Square waves |
| Truing conditions (for #1200) | Rotational speed of the grindstone 5,000 rpm Feed speed in the Y direction 5 mm/min Depth of cut 0.5 μm |
| Processing conditions (for #1200) | Rotational speed of the grindstone 5,000 rpm Feed speed in the Y direction 25 mm/min Pick feed stroke in the X direction 0.1 mm Depth of cut 20 μm |

Figure 6:
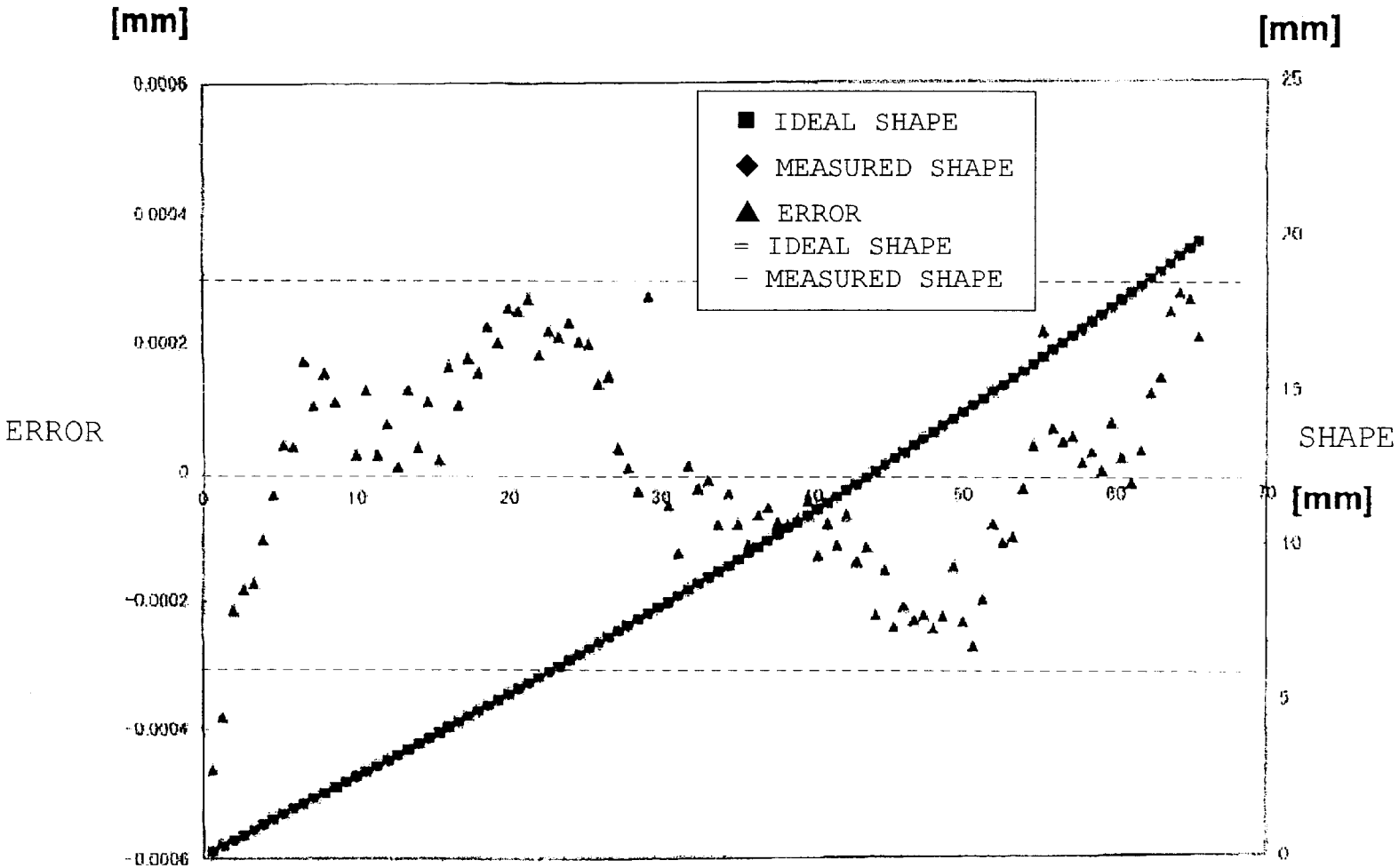
FIG. 6 shows errors in the shape produced by embodiments of the present invention.

FIG. 6 shows errors in the shapes of this embodiment. In FIG. 6, positions along the surface of the workpiece 1 in the X-axis direction are plotted along the abscissa. In the ordinates the marks ■ and ♦ show the ideal shapes and measured shapes respectively using the right scale, and the mark ▲ show errors (=ideal shapes−measured shapes) are plotted using the left scale.

Obviously from FIG. 6, the ideal shapes and the measured shapes substantially coincide with each other, and the errors do not exceed ±0.3 μm. Therefore, it can be seen that the accuracy of the shape of the reflecting surface of the axially asymmetric aspherical mirror after processing can be kept less than ¼ of the wavelength λ of the light used (for instance, 0.3 μm or less).

Regarding the surface roughness of the reflecting surface, because the ELID grinding device 10 is used, even if microscopic grinding grains are used, the grindstone does not become clogged unlike conventional grinding methods, and can process the workpiece very accurately and efficiently, as already known in the prior art, so an excellent mirror surface can be produced.

According to the method of the present invention as described above, the grindstone can be moved in 3 axial directions by the numerical control device 16, and the rotary truing device 12 can keep the circular arc of the surface 2*a* precisely true with a radius R on the outer periphery of the grindstone. In addition, because the electrolytic in-process dressing device 10 is used that removes metallurgically bonded grinding grains from the surface of the grindstone while the workpiece is being ground, even if microscopic grinding grains are incorporated, the device can process the workpiece with a high accuracy and a high efficiency without the problem of the grindstone becoming clogged that often occurs during conventional grinding methods. In addition, because the shape measuring device 14 can measure the circular arc shape of the surface of the grindstone after truing and the processed surface of the workpiece 1 after grinding, on the machine, and as the measured data can be used to correct the original processing data for the purpose of reprocessing, the preferred shape of the workpiece can be achieved very precisely by correcting for the wear of the grindstone and for processing errors.

Another aspect of the method of the present invention is that the electrolytic in-process dressing device 10, rotary truing device 12 and shape measuring device 14 are assembled on the same equipment, and the workpiece is also installed on the same installation device. Therefore, the workpiece need not be removed from the installation device, during repeated processing and measurements, so the reference surface of the optical elements need not be readjusted, and the reference surface is absolutely free from any change caused by remounting as in a conventional method.

As described above, the method of grinding the axially asymmetric aspherical mirror according to the present invention provides various advantages such as that an axially asymmetric aspherical mirror with a highly accurate shape, extremely small surface roughness, and the capability of reflecting or converging light precisely, can be manufactured within a short time with high accuracy.

The present invention should not be limited only to the above-mentioned embodiments, but can be modified in various ways as far as the scopes of the claims of the present invention are not exceeded.

What is claimed is:

1. A method of grinding an axially asymmetric aspherical mirror, comprising the steps of:

providing a workpiece;

providing a grinding apparatus comprising:

(a) a disk-shaped metal-bonded grindstone rotatable about an axis Y and that has an outer periphery surface that defines a circular arc with a radius R;

(b) an electrode that faces the grindstone and defines a space present between the electrode and the grindstone;

(c) a nozzle disposed to supply a conducting liquid between the electrode and the grindstone;

(d) a power supply device operably connected to apply a voltage between the grindstone and the electrode;

(e) an electrolytic in-process dressing device disposed to electrolytically dress the grindstone while the workpiece is being ground by the grindstone;

(f) a rotary truing device rotatable about an axis X orthogonal to the axis of rotation Y and disposed to true the circular arc surface;

(g) a shape measuring device disposed to measure the shape of the circular arc surface of the grindstone and the shape of a processed surface of the workpiece; and (h) a numerical control device operably connected to numerically control the grindstone in three axial directions X, Y and Z;

processing the workpiece by grinding with the grindstone;

truing the circular arc surface of the grindstone with the rotary truing device;

measuring the shape of the circular arc surface of the grindstone and the shape of the processed surface of the workpiece to provide on-machine measurements using the shape measuring device; and moving the grind stone in the three axial directions in accordance with the numerical control device, and repeating the steps of truing, processing, and measuring.

2. A method of grinding an axially asymmetric aspherical mirror as specified in claim 1, further comprising the steps of:

tilting the surface of the workpiece to be processed at between 30° and 60° from the axis of rotation Y; and fixing the surface of the workpiece to the grinding apparatus.

3. A method of grinding an axially asymmetric aspherical mirror as specified in claim 2, wherein the grindstone is moved relatively slowly in the X direction orthogonal to the direction of the axis of rotation Y, relative to the surface of the workpiece, and grinds the workpiece while the grindstone is fed in the direction of the axis of rotation Y of the grindstone.

4. A method of grinding an axially asymmetric aspherical mirror as specified in claim 3, wherein the shape measuring device is a laser shape measuring device.

5. A method of grinding an axially asymmetric aspherical mirror as specified in claim 3, wherein the shape measuring device is a laser shape measuring device.

* * * * *